United States Patent [19]

Jones et al.

[11] Patent Number: 4,778,544

[45] Date of Patent: Oct. 18, 1988

[54] LOW TOXIC NAVY BOARD FACING

[75] Inventors: Charles E. Jones, Hurt, Va.; William C. Schwartz, Greensboro, N.C.

[73] Assignee: Bulrington Industries, Inc., Greensboro, N.C.

[21] Appl. No.: 762,535

[22] Filed: Aug. 5, 1985

Related U.S. Application Data

[63] Continuation-in-part of Ser. No. 731,031, May 6, 1985, abandoned.

[51] Int. Cl.[4] ..... B32B 7/00; B32B 17/02; B32B 17/10

[52] U.S. Cl. ..... 156/60; 52/515; 106/18.12; 106/18.26; 156/71; 252/608; 427/397.8; 428/253; 428/268; 428/290; 428/442; 428/913; 428/920

[58] Field of Search ..... 428/268, 442, 913, 920, 428/253, 290; 427/398.8; 252/608; 106/18.12; 156/60

[56] References Cited

U.S. PATENT DOCUMENTS

| | | | |
|---|---|---|---|
| 4,255,483 | 3/1981 | Byrd et al. | 428/245 |
| 4,286,013 | 8/1981 | Darogga et al. | 428/921 |
| 4,522,673 | 6/1985 | Fell et al. | 428/252 |
| 4,526,830 | 7/1985 | Ferziger | 428/442 |
| 4,529,467 | 7/1985 | Ward et al. | 428/913 |
| 4,540,617 | 9/1985 | Kawanishi et al. | 428/137 |
| 4,542,067 | 9/1985 | Yamamoto et al. | 428/237 |
| 4,572,862 | 2/1986 | Ellis | 428/245 |
| 4,600,634 | 7/1986 | Langer | 428/283 |

*Primary Examiner*—James C. Cannon

*Attorney, Agent, or Firm*—Nixon & Vanderhye

[57] ABSTRACT

A process for manufacturing a coated, smooth, fabric useful as a Navy board facing and the like is described by first applying to at least one face of a glass fiber substrate a uniform layer of a flame-retardant coating containing a pigment, a flame-retardant and a resin contacting and encapsulating substantially all of the yarns of the substrate with a tough, adherent film, then drying the thus-coated substrate. The coated fabric, when exposed to heat or flame, emits vapors of low-toxicity and low-smoke.

40 Claims, No Drawings

LOW TOXIC NAVY BOARD FACING

CROSS-REFERENCE TO RELATED APPLICATIONS

This is a continuation-in-part of our earlier application Ser. No. 731,031, filed May 6, 1985, now abandoned.

BACKGROUND OF THE INVENTION

This invention relates to Navy board (sometimes called hull board) facing material which is a coated fabric that is generally adhered to a rigid fiberglass or mineral board and, in turn, is used to cover walls, partitions, etc., on board ships and in various industrial applications. The function is to provide insulation, sound deadening, fire resistance, and durability. Navy board facing materials are generally manufactured per the requirements of military specification MIL-C-20079 Type I, Class 2. This specification requires that the base fabric have a treatment. It is specifically this treatment or finish with which the present invention is concerned.

Navy board facing material made in accordance with the present invention is characterized by the following properties: (1) rigidity to span non-uniformities in the board carrier and to ease in fabrications; (2) slitability to aid in fabrication, sizing and handling of boards; (3) provides protection, cleanability and strength; (4) accepts both oil based and latex paints; and (5) most importantly, adds to the non-flammable nature of the base glass fabric without generating toxic gases normally associated with resin treated materials.

Recent experiences with Navy board indicates that halogen-containing products, for instance, those treated with a vinyl chloride finish, are no longer desirable because of the possibility of toxic fumes being generated by fire and/or heat. It is now a requirement of the British Navy that finishes having a high halogen content not be used.

The products of the present invention are both flame-retardant and low-toxic and find military as well as commercial applications. Examples include wall and ceiling coverings on ships and decorative pipe wrap in naval vessels.

SUMMARY OF THE INVENTION

The present invention provides a Navy board facing material useful as a Navy board facing or a wall board facing, and a process for making this facing which, when exposed to fire or extreme heat, does not emit noxious, often poisonous, gases.

It is an object of the present invention to produce an improved flame-retardant, low-toxic fabric for Navy board facing by applying a resin/flame retardant/pigment system that emits only low or preferably non-toxic vapors upon combustion.

It is another object of the present invention to provide an improved fabric for Navy board facing which exhibits the required smoke and flame resistance, color stability and heat stability.

These and other objects are achieved by selectively applying to a suitable base fabric, either woven or non-woven, a Navy board finish composed of resins, pigments, binders, flame retardants and other adjuvants. This coating or "finish" as it is termed in the art exhibits low-toxicity and low-smoking properties when exposed to heat or flame. The Navy board fabric of the present invention has a tight weave, non-textured, smooth appearance.

When exposed to heat or burned, the improved Navy board facing has a finish which releases only small amounts of fumes and those fumes that are released are relatively low-toxic fumes. These improvements are possible with the Navy board fabric having the unique finish which is the subject of the present invention and is described in more detail below.

The finish of the present invention may be applied using standard textile padding operations. The finish formulation consists of highly selective resin(s), flame-retardant(s), white pigments, and auxiliary chemicals as needed not only to develop the required appearance but also to achieve the low-toxicity and flame retardancy. The finish may be loaded with white or other pigments and one or more flame-retardants in order to pass required flame and smoke tests, the details of which are described below.

The carefully chosen chemical components in the disclosed formulation are essential to establishing the low-toxicity of the product when exposed to heat or fire. The finish is essentially free of halogens (chlorides, bromides, fluorides), nitriles, nitrates, cyanides, ammines, sulfates, phosphates, and other potentially offending chemical groups which can emit toxic fumes when burned. By judicious choice of finish components a product is prepared which when exposed to heat or burned yields as the principal products of combustion carbon dioxide, water vapor, and carbon monoxide. These gases of combustion are among the least toxic, and they are formed when any natural product such as wood is burned.

DESCRIPTION OF THE PREFERRED EMBODIMENTS

The substrate—The fabric used in the process of the present invention is preferably a smooth, tightly woven structure. In general terms, the fabrics used in the present invention are typically glass fiber fabrics. The glass fiber fabrics used are woven, knitted, or non-woven fabrics—most commonly woven—and are composed of yarn made of glass fibers or filaments, or in the case of non-wovens, discrete glass fibers. However, any fabric which has the desired tightly woven appearance may be used, provided that when the fabric is processed and coated according to the present invention, the final product satisfies the relevant flammability specifications and low or no toxicity on combustion requirements.

The fabric construction is controlled to a large extent by the military specification MIL-C-20079, Type 1 Class 2, which calls for a base fabric weight of 12.7≅10% OSY and a yarn count of 48±2 warp ends per inch and 32±2 filling yarns per inch. The type of yarn is not specified. The preferred base fabric according to the present invention is available from Burlington Glass Fabric, Burlington Industries, Incorporation, as style S/3732, having the following construction:

Weight: 12.76 OSY
Yarn Count (WXF) 48×32
Warp Yarn ECG 37 1/0
Fill Yarn ECG 37 1/0
E=electrical grade glass
C=continuous filament
G=average filament diameter (0.00036 in.)
37=37,000 yds/lb nominal of basic strand
1/0=one ply of a single yarn Applying the finish—The finish is conveniently applied as a resin bath solution. In such a procedure, which is commonly called "padding", the fabric is immersed in the resin bath, excess finish is squeezed out by passing the wet fabric through rubber to rubber or rubber to steel pad rolls and the still wet fabric is then dried in an oven. The applied and dried finish encapsulates the individual yarns with a tough film. Other procedures for applying the finish to the substrate may be used such as froth coating, spraying, kiss-coating, roller coating, printing, spraying, knife coating and the like.

A Navy board facing is produced by padding a glass fabric with a highly pigmented aqueous latex formulation. The fabric may be padded once or twice, or possibly more frequently, with a drying step in between, depending on the desired level of finish add-on.

Silicon Based Finish

Silicon resins or polymers are among the least toxic of all organic materials when exposed to a flame or high heat and these polymers are also useful as the resin component of the finish used in accordance with the present invention. Silicones are partially inorganic and partially organic. The backbone of the silicone polymer chain is the repeating Si-O unit, while the side groups are organic. When burned, these polymers emit fewer fumes and gases than totally organic polymers which have a carbon backbone. This is because only the organic portions of the silicone are capable of forming gases when burned while the inert portion forms inert silicon oxide powders. In contrast, virtually 100% of a totally organic polymer can be converted into gases with the carbon being converted to carbon monoxide and carbon dioxide.

Although the regular acrylic based finishes described herein are highly flame retardant and very low-toxic when exposed to a fire, there may be areas where even lower levels of flammability and toxicity may be desirable. This can be accomplished by replacing the acrylic latexes with silicone latexes or elastomers. A particularly suitable water-based silicone elastomer is manufactured by Dow Corning Corp., Midland, Mich., and is identified as Silastoc Q3-5024. It has good pigment binding properties and excellent bath stability.

The components in the finish used to make the Navy board facing of the present invention are specifically evaluated and selected for compatibility in the finish, lox-toxicity, flame retardancy, economics, and primarily, to achieve the desired properties in the final product.

A typical formulation based upon an acrylic resin is as follows:

Water—340 g
Aqueous Ammonia Solution (26%)—5 g
Tamol SN—5 g
Antifoam DB-110—3 g
Glycerin—5 g
Calcium carbonate—225 g
Aluminum hydrate—450 g
Rhoplex AC-22—220 g The first five components serve as the dispersing medium for the white pigments and the latex resin, and they also keep the finish from foaming excessively, from drying out, or from becoming unstable in processing.

Calcium carbonate is an economical inert white pigment that imparts whiteness and opacity to the finish.

Aluminum hydrate is a well known non-toxic flame retardant and smoke suppressant. When heated to 230° C., it liberates water vapor which helps dilute combustible gases. The particular aluminum hydrate is preferred in the form of an ultrafine particle size, preferably in the range of 1 to 2 microns. RH-730 is such an aluminum hydrate and was obtained from Reynolds Metals, Richmond, Va. It is white in color and also acts as a pigment to give extra whiteness and opacity to the finish.

Rhoplex AC-22, an acrylic resin, is an excellent pigment binder, even at high pigment loadings, and as such allows the formulator to use only a small amount of organic resin to hold the relatively large amounts of inert inorganic pigments to the fabric. When burned, the volume of organic gases given off thus is quite low. Other acrylic-based pigments may be used as well or mixtures of two or more acrylic resins or silicone latexes or elastomers. Also, mixtures of acrylic resins and silicone resins are contemplated.

All components were chosen for their non-toxic features in normal use and for their low-toxic properties when exposed to heat or flame. Although the pigment binder is organic, when it is burned, it emits primarily carbon dioxide, carbon monoxide, and water vapor. It is essentially free of noxious components including halides, sulfur, nitrogen, etc., which can form toxic fumes when burned.

EXAMPLE 1

This example illustrates the preparation of a Navy board facing in which the finish is padded onto the glass fiber substrate.

The following ingredients were mixed in the order listed in a high shear mixer:

Deionized water—23 gal
Calgon (sodiumhexametaphosphate)—2 lbs
Polywet ND-2—1 gal
Micral 932—200 lbs
Rhoplex AC-604—10 gal
Rhophex AC-22—8 gal
Ethylene glycol—1 gal Rhoplex AC-22 and AC-604 are acrylic latexes from Rohm & Haas Company, Philadelphia, Pa. Calgon (sodium hexametaphosphate) is a well known dispersing agent. Micral 932 is an ultra-fine aluminum hydrate powder from Solem industries, Norcross, Ga. Ethylene glycol is a humectant that helps in keeping the finish from drying out in process.

The chemicals given in the formulation are all considered to be low toxic when exposed to high temperature or to a fire. The hydrated alumina gives off water vapor at about 230° C. which cools the product and helps dilute other combustible gases which may be given off. The acrylic resins, AC-604 and AC-22, serve to adhere the powder to the fabric in similar fashion to a paint. Although AC-604 has a melamine additive which may produce nitrogen oxide fumes during burning, the amount is quite low considering the total volume of gases produced. AC-22 is a very low-toxic latex and, when burned, it emits primarily carbon dioxide and smaller amounts of carbon monoxide.

Some other resins or binders which produce relatively low-toxic fumes when burned include polyester, epoxy latexes, polyethylene and polypropylene emulsions, and silicone emulsions. In choosing binders for products requiring low toxicity of combustion gases, these resins have advantages in that the polymers are primarily composed of carbon, hydrogen, and oxygen. They are relatively free of nitrogen, sulfur, chlorine, bromine, and fluorine which may form toxic fumes in a fire.

The above formulation was padded onto a tightly woven glass fabric, Style S/3732, then dryed and cured. The resulting fabric exhibited a very smooth, attractive appearance suitable for a Navy board facing.

EXAMPLE 2

Another fabric is finished in a manner similar to Example 1 with modifications in the chemical formula.

Water—270 parts
Calgon—2 parts
Hydral 710—200 parts
WD resin—14 parts
Rhoplex AC-22—8 parts
Ethylene glycol—1 part Hydral 710 is an ultrafine particle size aluminum hydrate from Alcoa Co., Bauxite, Ark. WD resin is a polyester dispersion from Eastman Chemical Products, Inc., Kingsport, Tenn. Polyester resins are low toxic and, in this case, the WD resin acts as an excellent adhesive for improved weaveset properties.

EXAMPLE 3

An even more preferred formula for a low toxic formula involves substituting part of the acrylic resin with a silicone latex. The silicone produces less carbon dioxide and carbon monoxide when burned because of its partial inorganic structure and, the fewer gases released, the less toxic the product.

A glass fabric is coated with a formulation made by mixing the following components in the order given:

Water—250 parts
Calgon—2 parts
Polywet ND-2—2 parts
Micral 932—200 parts
Silastic Q3-5024—20 parts
Rhoplex AC-604–10 parts
Ethylene glycol—2 parts Silastic Q3-5024 is a water-based silicon elastomer from Dow Corning Corporation, Midland, Mich. It has good stability for processing conditions.

EXAMPLE 4

A Navy board facing was prepared by mixing together the following ingredients to make 50 gallons:

Water—32 gal
Tomol 850—900 ml
Hydrated alumina—200 lbs
Rhoplex AC-604—8 gal

Tamol 850 is a dispersing agent available from Rohm & Haas, the hydrated alumina was obtained from Reynolds Metals Co., Richmond, Va., as RH-730. Rhoplex AC-604 is a firm acrylic resin also available from Rohm & Haas.

This formulation was padded onto glass fabric style S/3732 at a wet pick-up of about four ounces per square yard, then dried and cured for three minutes in a forced air oven. The product was then tested for flame, smoke and toxicity, as explained in detail below.

Flame, Smoke and Toxicity tests

This test is used to evaluate synthetic materials when they are subjected to high temperature heating. The test results are to evaluate the potential hazard from toxic gases produced should the material be burned or thermally decomposed in an enclosed area. The data developed include the determination of ignition time, burning time, composition of the atmosphere produced, and weight loss of material.

Procedure

The equipment used to burn or thermally decompose the sample material is similar to the equipment formerly employed at the Materials Laboratory of the New York Naval Shipyard and by the Bureau of Mines Central Experiment Station at Pittsburgh for determining the flame resistance of thermosetting plastics, also as repeated in U.S. Testing Company report #83413, for the Bureau of Ships, U.S. Navy and referenced in Military Specification MIL-M-14G.

The equipment consists of a specimen support, heating coil and spark generators mounted in an essentially gas tight chamber, equipped with facilities for sampling the test atmospheres produced. In brief, the tests are conducted by placing a stick or sticks of the materials to be tested (sample size—$5'' \times \frac{1}{2}'' \times \frac{1}{2}''$) in the center of a heating coil which is situated in the air tight chamber.

The heating coil is activated and the number of seconds it takes from the time the coil is activated until the sample begins to burn is recorded as the ignition time. After the stick has burned for 30 seconds, the heating coil is deactivated, and the number of seconds it takes for the sample to stop burning (from the time of deactivation) is recorded as the burning time. When the sample has stopped burning, the atmosphere produced is mixed by an internal circulating fan. A manifold circulating pump is then activated and the atmosphere within the chanber is withdrawn into gas analyzing apparatus.

A Navy board facing material according to Example 4 was tested using the above procedure. Four separate samples of the same facing were tested with the results reported for each sample as well as an average for all four samples.

| Results: | 1 | 2 | 3 | 4 | Average |
|---|---|---|---|---|---|
| Original Weight (gms.) | 22.87 | 23.15 | 22.73 | 23.02 | — |
| Residual Weight (gms.) | 22.35 | 22.62 | 22.20 | 22.50 | — |
| Loss in Weight (gms.) | 0.52 | 0.53 | 0.53 | 0.52 | 0.53 |
| Temperature of Coil | (a) | (a) | (a) | (a) | |
| Ignition Time (secs*) | 419.1 | 418.8 | 419.5 | 419.5 | 419.2 |
| Burning Time (secs) | 0 | 0 | 0 | 0 | 0 |
| Temperature of Chamber °C. | 28 | 28 | 25 | 26 | 27 |
| Beilstein Test | (b) | (b) | (b) | (b) | |
| Smoke | (c) | (c) | (c) | (c) | |
| Flame | (d) | (d) | (d) | (d) | |
| Ash | (e) | (e) | (e) | (e) | |

Composition of Atmosphere (in ppm)

| | 1 | 2 | 3 | 4 | Average |
|---|---|---|---|---|---|
| Hydrogen Chloride | 0 | 0 | 0 | 0 | 0 |
| Aldehydes as HCHO | 2 | 2 | 2 | 2 | 2 |
| Ammonia | 0 | 0 | 0 | 0 | 0 |
| Carbon Monoxide | 175 | 200 | 175 | 175 | 181 |
| Carbon Dioxide | 500 | 600 | 500 | 500 | 525 |
| Oxides of Nitrogen as $NO_2$ | 10 | 12 | 12 | 10 | 11 |
| Cyanides as HCN | 0 | 0 | 0 | 0 | 0 |

(a) Equilibrium temperature 600° C.
(b) Negative
(c) Light amount of light grey smoke
(d) No flame
(e) No deposits were observed
*Sample did not ignite. This is heating time.

This test demonstrates that the ignition atmosphere contained, in the order of concentration, predominantly carbon dioxide with some carbon monoxide and only minor amounts of nitrogen dioxide with hardly a trace (2 ppm) of aldehydes. Cyanides, hydrogen chloride and ammonia were not detected. As used herein, halogen-free means free or substantially free of chlorides, bromides, and fluorides. Amounts of components in the test atmosphere reported above, other than carbon dioxide and monoxide, are all less than 100 ppm, preferably less than 50 ppm and most desirably less than 15 ppm.

Another method of evaluation is to compare the results of candidate facings with wood, for example oak or redwood, and relate the $LD_{50}$ and $LC_{50}$ values of each upon combustion. Acceptable facings will have toxicity values not higher than those of wood and preferably less than wood.

We claim:

1. A process for manufacturing a coated fabric that is rigid, slitable, cleanable, paintable with both oil based and latex paints, substantially non-flammable and is useful as a Navy board facing and the like, the process comprising:

(1) applying to at least one face of a fabric substrate a uniform layer of a thickened flame-retardant, non-cellular, water-based coating substantially devoid of halogen-containing components and containing a pigment, a flame-retardant and a resin, the coating contacting and encapsulating substantially all of the yarns of the substrate with a tough, adherent film, the coating composition, when exposed to heat or flame, emitting vapors of low-toxicity and low smoke, and (2) drying the thus-coated substrate.

2. The process of claim 1 in which the textured fabric is a tightly woven glass greige fabric.

3. The process of claim 1 in which the coating is applied by padding an aqueous composition onto the fabric substrate.

4. The process of claim 3 in which the layer is applied to the substrate to provide a total add-on at the completion of drying of at least one ounce per square yard of fabric.

5. The process of claim 4 in which the total add-on is up to about 1.5 ounces per square yard.

6. The process of claim 1 in which the fabric when exposed to thermal decomposition emits less than 100 parts per million of halogens.

7. The process of claim 1 in which the fabric when exposed to thermal decomposition emits less than 100 parts per million of aldehyde as HCHO.

8. The process of claim 1 in which the fabric when exposed to thermal decomposition emits less than 100 parts per million of ammonia.

9. The process of claim 1 in which the fabric when exposed to thermal decomposition emits less than 50 parts per million of oxides of nitrogen measured as $NO_2$.

10. The process of claim 1 in which the fabric when exposed to thermal decomposition emits less than 100 parts per million of cyanides as HCN.

11. A process for producing a coated, Navy board comprising laminating the coated, flame-resistant fabric of claim 1 onto a board substrate.

12. A smooth fabric suitable for use as a Navy board facing having a thick, opaque flame-retardant coating adhered substantially evenly to the yarns of the fabric produced by the process of claim 1.

13. A Navy board facing that is rigid, slitable, cleanable, paintable with both oil based and latex paints, substantially non-flammable consisting of a woven glass fiber having thereon a uniform, thickened, flame-retardant, non-cellular coating containing pigment, at least one flame retardant and a non-toxic resin contacting and securing the coating to the glass fiber fabric with a tough, adherent film, the coating having been derived from a water-based coating and being substantially completely devoid of halogen-containing components, and, when exposed to heat or flame, emitting only low-toxic, low-smoke vapor.

14. The Navy board facing of claim 13 in which the toxicity of the vapors emitted by the coating is no more toxic than wood when exposed to the same conditions of heat and/or flame.

15. The Navy board facing of claim 13 in which the fabric when exposed to thermal decomposition emits less than 100 parts per million of halogens.

16. The Navy board facing of claim 13 in which the fabric when exposed to thermal decomposition emits less than 100 parts per million of aldehyde as HCHO.

17. The Navy board facing of claim 13 in which the fabric when exposed to thermal decomposition emits less than 100 parts per million of ammonia.

18. The Navy board facing of claim 13 in which the fabric when exposed to thermal decomposition emits less than 100 parts per million of cyanides as HCN.

19. The Navy board facing of claim 13 which the fabric when exposed to thermal decomposition emits less than 50 parts per million of oxides of nitrogen measured as $NO_2$.

20. The Navy board facing of claim 13 that satisfies the requirements of MIL-C-20079, Type I, Class 2.

21. A process for manufacturing a coated fabric that is rigid, slitable, cleanable, paintable with both oil and latex points substantially non-flammable and is useful as a Navy board facing and the like, the process comprising:

(1) applying to at least one face of a fabric substrate a uniform layer of a thickened, flame-retardant, non-cellular coating substantially devoid of halogen-containing components and containing a pigment, a water-based silicone-containing resin, at least an equal amount by weight of an acrylic resin and a hydrated salt flame retardant, the coating contacting and encapsulating substantially all of the yarns of the substrate with a tough, adherent film, the coating composition, when exposed to heat or flame, emitting vapors of low-toxicity and low-smoke, and (2) drying the thus-coated substrate.

22. The process of claim 21, in which the textured fabric is a tightly woven glass greige fabric.

23. The process of claim 21, in which the coating is applied by padding an aqueous composition onto the fabric substrate.

24. The process of claim 23, in which the layer is applied to the substrate to provide a total add-on at the completion of drying of at least one ounce per square yard of fabric.

25. The process of claim 24, in which the total add-on is up to about 1.5 ounces per square yard.

26. The process of claim 21, in which the fabric when exposed to thermal decomposition emits less than 100 parts per million of halogens.

27. The process of claim 21, in which the fabric when exposed to thermal decomposition emits less than 100 parts per million of aldehyde as HCHO.

28. The process of claim 21, in which the fabric when exposed to thermal decomposition emits less than 100 parts per million of ammonia.

29. The process of claim 21, in which the fabric when exposed to thermal decomposition emits less than 50 parts per million of oxides of nitrogen measured as $NO_2$.

30. The process of claim 21, in which fabric when exposed to thermal decomposition emits less than 100 parts per million of cyanides as HCN.

31. A process for producing a coated, Navy board comprising laminating the coated, flame-resistant fabric of claim 21 onto a board substrate.

32. A smooth fabric suitable for use as a Navy board facing having a thick, opaque flame-retardant coating adhered substantially evenly to the yarns of the fabric produced by the process of claim 21.

33. A Navy board facing that is rigid, slitable, cleanable, paintable with both oil based and latex paints, and is substantially non-flammable, the facing consisting of a woven glass fiber fabric having thereon a uniform, thickened, flame-retardant, non-cellular coating containing pigment, a non-toxic, silicone-containing resin binder, at least an equal amount by weight of an acrylic resin binder and a hydrated salt flame retardant, the resin binders contacting and securing the coating to the glass fiber fabric with a tough, adherent film, the coating having been derived from a water-based composition and being substantially completely devoid of halogen-containing components and, when exposed to heat or flame, emitting only low-toxic, low-smoke vapor.

34. The Navy board facing of claim 33, in which the toxicity of the vapors emitted by the coating is no more toxic than wood when exposed to the same conditions of heat and/or flame.

35. The Navy board facing of claim 33, in which the fabric when exposed to thermal decomposition emits less than 100 parts per million of halogens.

36. The Navy board facing of claim 33, in which the fabric when exposed to thermal decomposition emits less than 100 parts per million of aldehyde as HCHO.

37. The Navy board facing of claim 33, in which the fabric when exposed to thermal decomposition emits less than 100 parts per million of ammonia.

38. The Navy board facing of claim 33, in which the fabric when exposed to thermal decomposition emits less than 100 parts per million of cyanides as HCN.

39. The Navy board facing of claim 33, in which the fabric when exposed to thermal decomposition emits less than 50 parts per million of oxides of nitrogen measured as $NO_2$.

40. The Navy board facing of claim 33, that satisfies the requirements of MIL-C-20079, Type I, Class 2.

* * * * *